United States Patent [19]

Korger

[11] 4,088,345

[45] May 9, 1978

[54] SLIDING DEVICE

[75] Inventor: Heinz Korger, Niederstotzingen, Germany

[73] Assignee: Hannes Marker, Garmisch-Partenkirchen, Germany

[21] Appl. No.: 738,062

[22] Filed: Nov. 2, 1976

[30] Foreign Application Priority Data

Nov. 3, 1975 Germany ..... 2549203

[51] Int. Cl.[2] ..... A63C 11/00

[52] U.S. Cl. ..... 280/636; 108/136

[58] Field of Search ..... 280/636, 618, 620; 108/68, 136, 143

[56] References Cited

U.S. PATENT DOCUMENTS

| | | | |
|---|---|---|---|
| 3,079,165 | 2/1963 | Von Bosio | 280/636 |
| 3,448,990 | 6/1969 | Cubberly et al. | 280/636 |
| 3,515,402 | 6/1970 | Weiss | 280/636 |
| 3,689,094 | 9/1972 | Marker et al. | 280/636 |
| 3,837,664 | 9/1974 | Asp | 280/636 |
| 3,905,906 | 9/1975 | Edmund | 280/636 |

FOREIGN PATENT DOCUMENTS

| | | | |
|---|---|---|---|
| 1,578,818 | 12/1970 | Germany | 280/636 |

*Primary Examiner*—David M. Mitchell
*Attorney, Agent, or Firm*—Fleit & Jacobson

[57] ABSTRACT

In a sliding device for a ski boot that is to be released from a safety ski binding and that comprises a supporting plate securable to the ski and a slide plate displaceable on said supporting plate against the force of at least one spring, positive guiding means for the slide plate on the supporting plate are avoided insofar that only the spring is used to hold the plates together, there being substantially line contact between the two plates in a direction transverse of the ski.

9 Claims, 5 Drawing Figures

Fig. 4
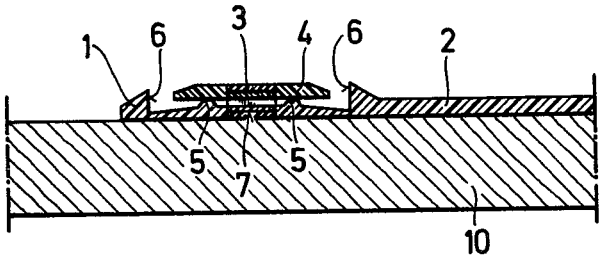
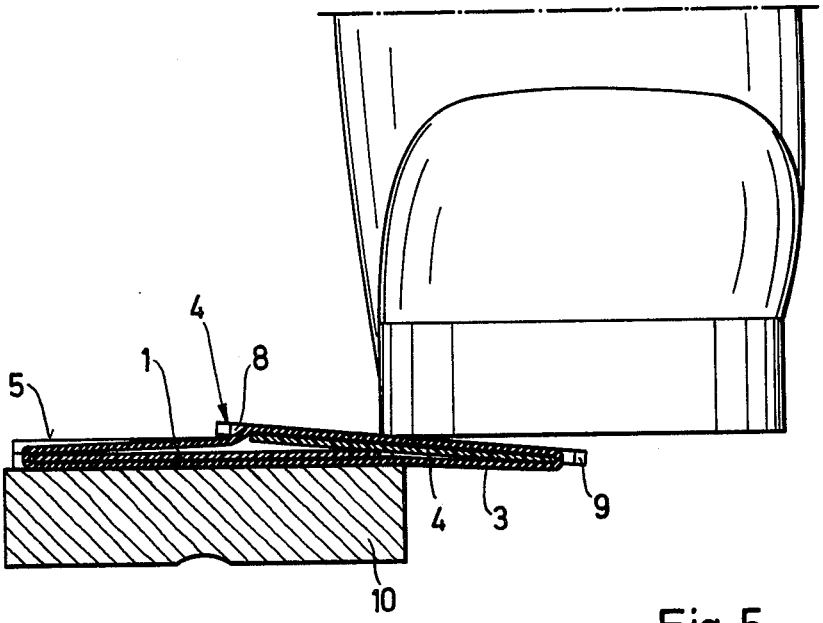
Fig. 5

SLIDING DEVICE

The invention relates to a sliding device for a ski boot that is to be released from a safety ski binding, comprising a supporting plate for securing to the ski and a slide plate displaceable on said supporting plate against the force of at least one spring.

A sliding device of this type is described in German Offenlegungsschrift 1578818, entitled "Sohlenauflageplatte fur Skibindungen, " filed Mar. 3, 1966. The slide plate is held down on the supporting plate perpendicular to the plane of the ski and is guided transversely of the length of the ski with the aid of grooves and it is displaceable on the supporting plate out of a central position transversely to the length of the ski against the force of a spring. The object of achieving substantially constant frictional forces on the ski when the ski boot is moved to be released, is attained if, for example, the boot rests on the slide plate and the slide plate moves along the supporting plate.

The disadvantage of this arrangement, particularly for modern bindings with long damping paths, resides in a limited displaceability of the slide plate on the supporting plate as occasioned by constructional considerations. When the slide plate is displaced beyond the width of the ski, for example under the pressure of the boot or by reason of obstructions sweeping laterally past the ski, the slide plate must not move more than a few millimeters in the practical embodiment of such a sliding device. However, such limited displacement prevents the sliding device from being applied to modern bindings which may have an elastic path of several centimeters. Another disadvantage of the known sliding device is its sensitivity to surrounding influences, e.g. soiling and icing up, as occasioned by the large frictional and guide faces.

It is therefore an object of the present invention to provide a sliding device in which the mobility of the slide plate is not limited by a fixed or almost fixed abutment of the supporting plate. Further, the detrimental influences on the function of the sliding device caused by icing up or soiling are to be kept to a minimum.

According to the invention, the slide plate is held on the supporting plate only by said spring so as to avoid the provision of fixed guiding means, the slide and supporting being in substantial line contact with each other substantially transversely of the length of the ski.

In the slide plate of the device according to the invention, the boot to be released from the ski rests on the slide plate over the entire lateral releasing path of the safety ski binding, the slide plate being moved on the supporting plate. The spring between the slide plate and supporting plate interconnects the two parts and is so designed that, even with bindings having a very long stroke, the slide plate is brought back to the starting position only when the boot leaves the plane of the ski after the binding has been released. This ensures that the favorable frictional conditions between the slide plate and supporting plate are maintained over the entire releasing operation.

The relatively high specific pressure occasioned by the weight of the skier and the substantially linear contact of the slide plate for the most part prevents icing up between the slide and supporting plates. Particles of dirt are pushed out through spaces between the plates. Another advantage resides in the simple maintenance of the device; the slide plate is simply lifted against the relatively low force of the spring and the interior of the device can then be cleaned.

The upper side of the supporting plate and/or the underside of the slide plate preferably comprise(s) at least one rib providing a line contact of a width no more than 2 mm.

The spring is preferably a rubber spring which has a meandering form and/or is endless. A meandering form ensures that the return force of the spring increases only slightly with an increase in the deflection.

To permit simple and rapid replacement of the slide plate, it is advantageous for the rubber spring to be guided in a recess of the supporting plate and in outwardly open slots of the slide plate.

In a particular embodiment of the invention, abutment faces are provided on the supporting plate to limit resilient displacement of the slide plate lengthwise of the ski.

It is within the scope of the present invention to extend the slide plate to form a so-called sole plate of a plate binding on which the boot is then held so that it can only be deliberately released.

An example of the invention is illustrated in the accompanying drawings, wherein:

FIG. 4 is a section on the line IV—IV in FIG. 3, and

FIG. 5 is a sectional view corresponding to that of FIG. 2 but showing the displaced sliding plate at the instant when the boot is removed from the plane of the ski.

Figure 1:
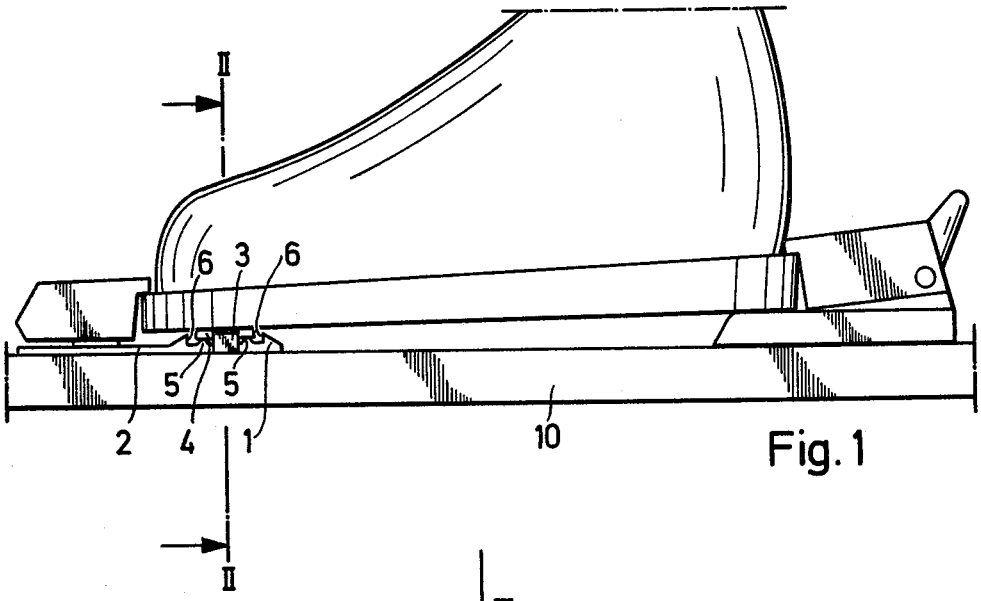
FIG. 1 is a fragmentary side elevation of a ski provided with a releasable toe and heel binding and a sliding device according to the invention provided in the vicinity of the binding which reacts to lateral loads.
Figure 2:
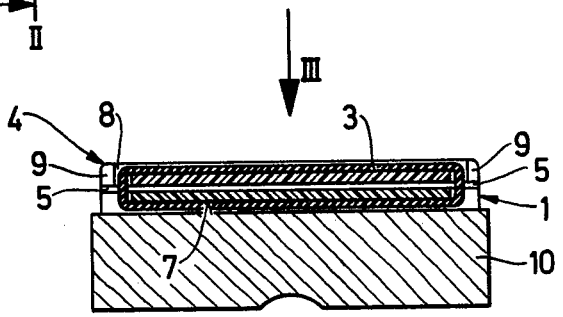
FIG. 2 is an enlarged cross-section of the ski taken through the sliding device of the invention.
Figure 3:
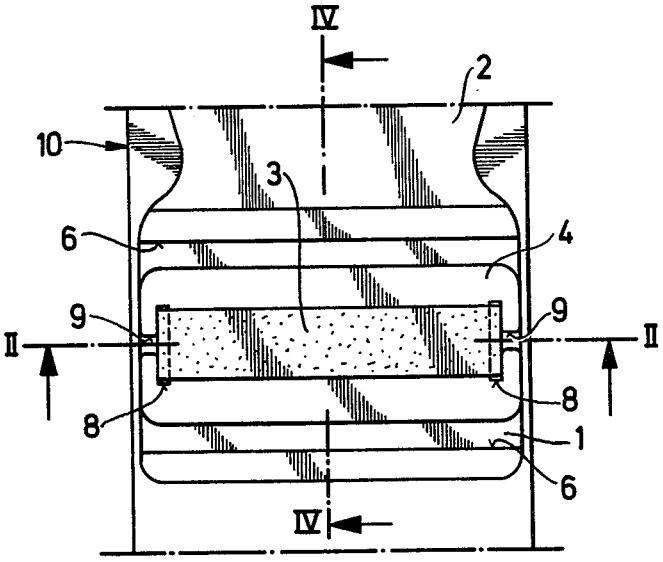
FIG. 3 is a plan view of the FIG. 2 sliding device.

In the illustrated embodiment, the sliding device according to the invention is, with the aid of an extension 2 of the supporting plate 1, screwed to the ski 10 (FIG. 1) together with the toe holder.

By means of a rubber spring 3, the slide plate 4 is held to the supporting plate 1. The points of contact between the supporting plate 1 and slide plate 4 are formed by substantially wedge-shaped ribs 5 of the supporting plate that extend transversely to the length of the ski. The movement of the slide plate 4 lengthwise of the ski is limited by abutment faces 6 of the supporting plate.

By guiding the annular rubber spring 3 in a recess 7 of the supporting plate and in slots 8 of the slide plate 4, the slide plate is reliably and securely mounted. Apertures 9 provide an opening for the slots to the outside. This manner of mounting facilitates the rapid and cheap assembly and possible replacement of the components.

The supporting plate 2 is made in one piece with the ribs 5 from plastics material. Similarly, the slide plate 4 is made in one piece from a material which results in low coefficients of friction with the material of the supporting plate. It is, however, conceivable to provide the slide plate 4 with substantially wedge-shaped ribs or to provide one of the two plates with inserts of low-friction material having the desired wedge shape.

I claim:

1. A sliding device for a ski boot that is to be released from a safety ski binding, comprising a supporting plate for securing the sliding device to a ski, a slide plate displaceable on said supporting plate, spring means for holding said slide plate on said supporting plate, said slide plate being displaceable on said supporting plate against the force of said spring means, one of said supporting and slide plates including support means extending into contact with a facing surface of the other of said supporting and slide plates, said support means providing a transversely extending area of contact less than the area of said one plate so that said slide and supporting plates contact each other in a limited area that extends substantially transversely of the length of the ski, said slide plate when not displaced being contacted by only said support plate and said spring means.

2. The device as defined in claim 1, wherein the upper side of said supporting plate and the underside of said slide plate face each other and said support means includes at least one rib defining a transversely extending contact area of a width no more than 2 mm, said rib extending from one of said facing sides into contact with the other of said facing sides.

3. The device as defined in claim 2, wherein the cross-section of the rib in a direction parallel to the length of the ski is substantially wedge-shaped.

4. The device as defined in claim 1, wherein said spring means is a rubber spring.

5. The device as defined in claim 4, wherein said rubber spring is endless.

6. The device as defined in claim 4, wherein said rubber spring is guided in a recess of said supporting plate and in spaced apart slots extending through said slide plate parallel to the length of the ski.

7. The device as defined in claim 6 wherein said slide plate includes openings extending transversely from said slots thru the edges of said slide plate.

8. The device as defined in claim 1, wherein upwardly extending abutment faces are provided on said supporting plate to limit resilient displacement of said slide plate lengthwise of the ski, said abutment faces being positioned on said supporting plate in such manner that displacement of said slide plate in a direction parallel to the length of the ski is limited by contact between said slide plate and one of said abutment faces.

9. A sliding device for a ski boot that is to be released from a safety ski binding, comprising a supporting plate for securing the sliding device to a ski, a slide plate positioned with its underside facing the upper side of said supporting plate and being displacable on said supporting plate, one of said facing sides including a rib defining a transversely extending contact area of a width no more than 2mm, said rib extending into contact with the other of said facing sides thereby providing a line of contact between said supporting plate and said slide plate and spring means for holding said slide plate on said supporting plate, said slide plate being displacable on said supporting plate against the force of said spring means.

* * * * *